United States Patent [19]

Sacuta

[11] 4,450,909

[45] May 29, 1984

[54] COMBINATION SOLVENT INJECTION ELECTRIC CURRENT APPLICATION METHOD FOR ESTABLISHING FLUID COMMUNICATION THROUGH HEAVY OIL FORMATION

[75] Inventor: Aleksy Sacuta, Edmonton, Canada

[73] Assignee: Alberta Research Council, Edmonton, Canada

[21] Appl. No.: 313,748

[22] Filed: Oct. 22, 1981

[51] Int. Cl.[3] ..... E21B 43/24; E21B 43/25

[52] U.S. Cl. ..... 166/248; 166/272

[58] Field of Search ..... 166/248, 272, 268, 274

[56] References Cited

U.S. PATENT DOCUMENTS

| | | | |
|---|---|---|---|
| 3,782,465 | 1/1974 | Bell et al. | 166/272 X |
| 4,010,799 | 3/1977 | Kern et al. | 166/248 |
| 4,084,637 | 4/1978 | Todd | 166/248 |
| 4,228,854 | 10/1980 | Sacuta | 166/248 |

FOREIGN PATENT DOCUMENTS

| | | | |
|---|---|---|---|
| 1031689 | 5/1978 | Canada | 166/248 |

*Primary Examiner*—Stephen J. Novosad

*Attorney, Agent, or Firm*—Ernest P. Johnson

[57] ABSTRACT

A fluid communication channel is developed between injection and product wells in a heavy oil formation by simultaneously injecting a solvent for the oil and passing electric current through the formation.

1 Claim, 2 Drawing Figures

INJECTION RATE
30cc/h
24cc/h
OVERBURDEN - 500 PSIG
SOLVENT - KEROSENE
750 VAC
TEMP
PRESS
INJECTION PRESSURE PSIG
75
50
25
0
CORE TEMPERATURE °C
30
20
10
0
INJECTION TIME HOURS
0
1
2
3
4
5
6
7
8

COMBINATION SOLVENT INJECTION ELECTRIC CURRENT APPLICATION METHOD FOR ESTABLISHING FLUID COMMUNICATION THROUGH HEAVY OIL FORMATION

BACKGROUND OF THE INVENTION

1. Field of the Invention

This invention relates to a method for establishing a fluid communication channel between injection and production wells in a heavy oil reservoir. More particularly, the invention is concerned with injecting a solvent into the formation while simultaneously passing electric current between electrodes positioned in the wells.

2. Description of the Prior Art

The invention has been developed in connection with the tar sand of the Athabasca reservoir in Alterta, Canada. It has application to other heavy oil reservoirs. However, it will be described below in connection with such tar sand and the problems which characterize it.

Athabasca tar sand comprises unconsolidated or discrete sand particles encapsulated in thin envelopes of water. The void spaces between the water-sheathed sand grains are filled with the bitumen which is to be recovered. As a formation, the unheated tar sand is relatively impermable. Fluids, such as steam or flood solution, cannot easily be injected into the formation. This difficulty is further compounded by the relatively thin overburden (600' to 1200') overlying the formation. There is a likelihood that formation fracturing with the use of high injection pressures will result.

One approach which has been investigated to get around these problems has involved trying to first develop a narrow, permeable interwell channel or path extending through the formation between the injection and production wells, using special techniques. Once this channel is open and fluid communication between the wells exists, it is then possible to inject steam into the channel. The injected steam heats the bitumen around the channel. This now-mobile bitumen flows into the channel and is driven to the production well. In this manner, the channel is gradually widened and the formation bitumen may be recovered.

One specific method previously suggested for developing such a channel involves injecting a bitumen solvent, such as naphtha or kerosene, directly into the untreated reservoir. It would be anticipated that the solvent would move through the formation through the latter's water and gas phases and would reduce the viscosity of bitumen which is contacted, thereby mobilizing the bitumen. However, when this method is practiced, particularly with formations having a relatively low water and gas saturation, it is frequently found that the injection pressure gradually increases and eventually reaches an unacceptable level, before breakthrough to the production well is achieved.

SUMMARY OF THE INVENTION

In accordance with the invention, it has been found that simultaneously applying electric current to the formation while injecting a solvent for heavy oil provides an improved process for opening up a fluid communication channel between injection and production points in a previously unheated heavy oil reservoir. Solvent injection may be continued until there is a breakthrough at the production well, or a smaller solvent slug may be followed with a drive fluid to force the solvent as far as the production well.

Broadly stated, the invention is a method for opening a fluid communication channel between injection and production wells in a previously unheated heavy oil reservoir wherein the oil is not amenable to being produced by a drive fluid, which comprises: injecting a solvent for the heavy oil into the reservoir either as a slug in advance of a drive fluid or until it breaks through at the production well, all without heating by injected fluid that section of the reservoir through which the solvent is passing; and, while solvent is moving through the reservoir, passing electric current through the reservoir between electrodes positioned in the injection and production wells.

DESCRIPTION OF THE PREFERRED EMBODIMENT

The solvent used is a low viscosity hydrocarbon which will reduce the viscosity of the heavy oil or bitumen through solubilization and dilution when it contacts it. Suitable examples are naphtha, kerosene, diesel and fuel oil, gas condensate and light crude.

The electrical current applied may be D.C. or A.C. In the case of D.C., it is preferred that the polarity of the electrode at the injection point be positive, with that at the production point being negative. An electroosmotic effect which assists in the penetration of the solvent is obtained by this preferred D.C. arrangement.

The electrical current is applied concurrently with injection of the solvent. This may be done throughout the solvent injection period or alternatively only during part of the period, when the injection pressure becomes high; the former is preferred, as it provides a continuing directional influence on the advancing solvent.

Following breakthrough of the solvent at the production point, one of a number of water based fluid drives may be used to cause the solvent and bitumen to move to the production well. This provides for an early solvent-bitumen recovery and produces a more dependable communication path for subsequent thermal methods.

The invention is exemplified by the following examples.

EXPERIMENTAL APPARATUS

Figure 1:
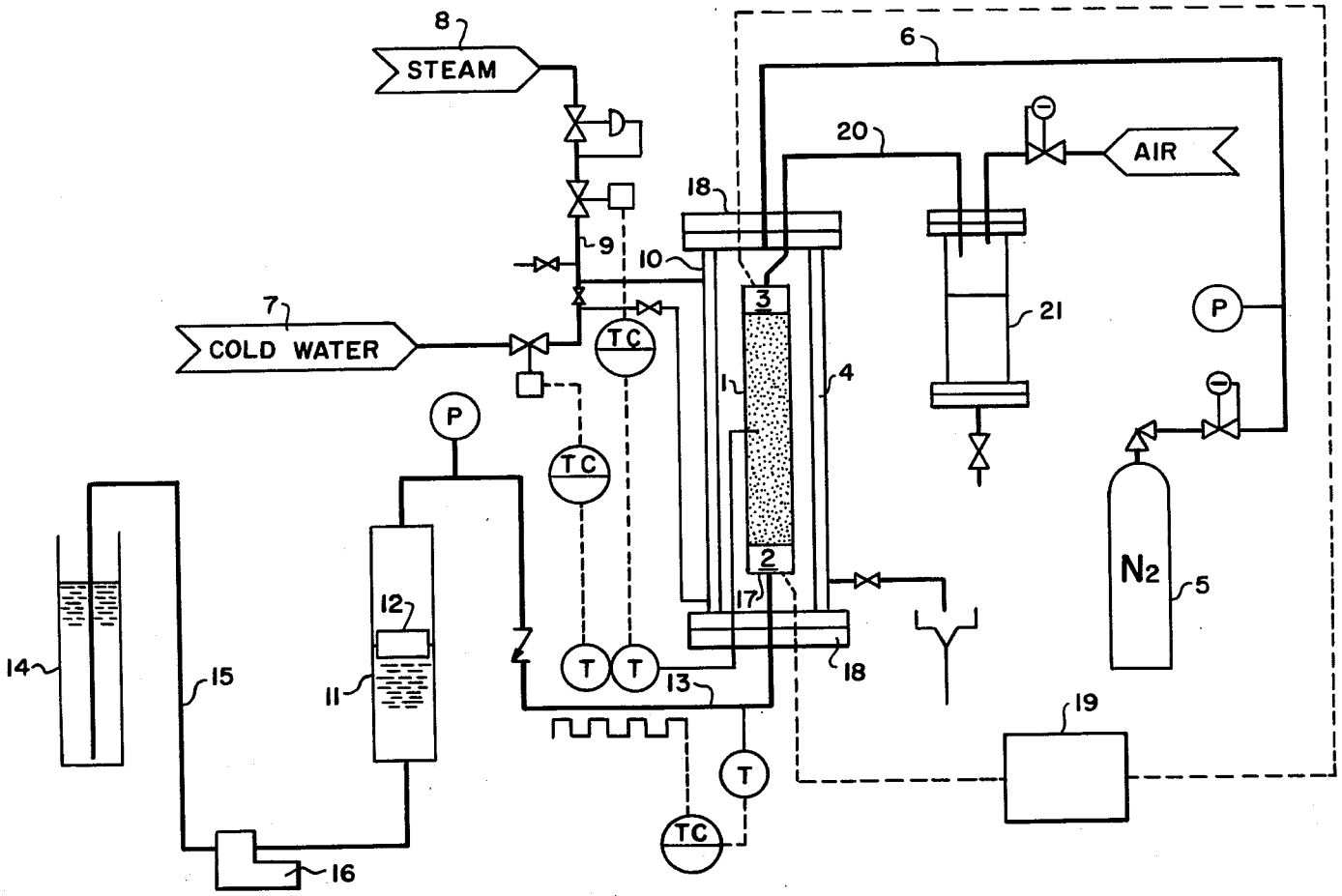
FIG. 1 is a schematic showing the laboratory apparatus used to carry out the experiments reported hereinbelow.

The experiments associated with this invention were carried out in apparatus schematically shown in FIG. 1. More particularly, there was provided a fibrecast tube 1 having a length of 3 feet and inside diameter of 3 inches. This tube was packed with approximately 15 pounds of tar sand. Electrodes 2, 3 were provided in the form of floating pistons, one being positioned in the tube at each end of the charge of tar sand. Each electrode was a cylindrical steel body having O-ring seals mounted in its outer surface. The electrodes were adapted to slide within the tube when pressurized at their outer ends, while maintaining the tube contents sealed.

The tube 1 was mounted in a cylindrical vessel 4. Pressurized nitrogen could be supplied from a bottle 5 through line 6 to the interior of the vessel 4. This nitrogen pressure would act to force the piston electrodes 2,3 inwardly, thereby compressing the tar sand charge and simulating the application of overburden pressure.

Cold water and steam sources 7, 8 were connected by a suitable valve and line system 9 to a jacket 10 surrounding the vessel 4. Thus the temperature of the vessel contents could be controlled.

A cylinder 11 containing a floating piston 12 was provided to supply solvent or drive fluid through the line 13, extending through the lower piston electrode 2, to the core. A water reservoir 14 was connected through the line 15 and metering pump 16 with the lower end of the cylinder 11. The water could be pumped into the cylinder 11 to displace the floating piston 12 and force the charge of solvent or drive fluid into the lower end of the tar sand column 17.

Electric power was supplied into vessel 4 by means of ceramic feed-through devices 18 and the electrodes 2, 3, from an AC/DC power source 19. The source 19 was capable of generating a variable voltage differential across the electrodes 2,3, of from 0 to 750 volts.

A product line 20 connected with an outlet bore (not shown) extending through the upper electrode 3, delivered production to a glass receiver 21.

EXAMPLE I

This example demonstrated that cold solvent injection would enter tar sand and initiate a communications path. However pressure differential build-up did occur; this differential was reduced when electrical assist was employed and communication between injection and production points was successfully re-established and maintained.

The 3" diameter fibrecast tube 1 was first equipped at its lower end with the electrode 2. This electrode was one faced with a ⅛" thickness of porous, sintered stainless steel and equipped with three circumferential neoprene O-rings. The piston-like electrode 2 was coated with a silicone lubricant and inserted into the lower end of the tube 1. The unit was then weighed and set on a base for filling with oil sand.

The tube 1 was packed with 6920 grams of oil sand containing 14.9% bitumen and 1.6% water by weight. This was done by adding 350 gram batches to the tube and packing them firmly with a steel rod. When loading was complete, the tube 1 contained a column of oil sand having a length of 81 cms. The upper surface of the column was spaced about 5 cms. from the upper end of the tube.

A layer of about 230 grams of 16–30 mesh size steel shot was placed on the column of oil sand. This layer was saturated with 20 grams of water. Then 40 and 30 mesh stainless steel screens were laid over the shot. An upper electrode 3, similar in construction to the lower electrode and having a length of 4 cms., was inserted to complete filling the tube 1.

The electrical and fluid lines were connected to the tube. Nitrogen was introduced into the outer vessel 4 to provide pressure of 500 psig. Cooling water was circulated through the jacket 10 to attain a temperature of 10±1° C.

Figure 2:
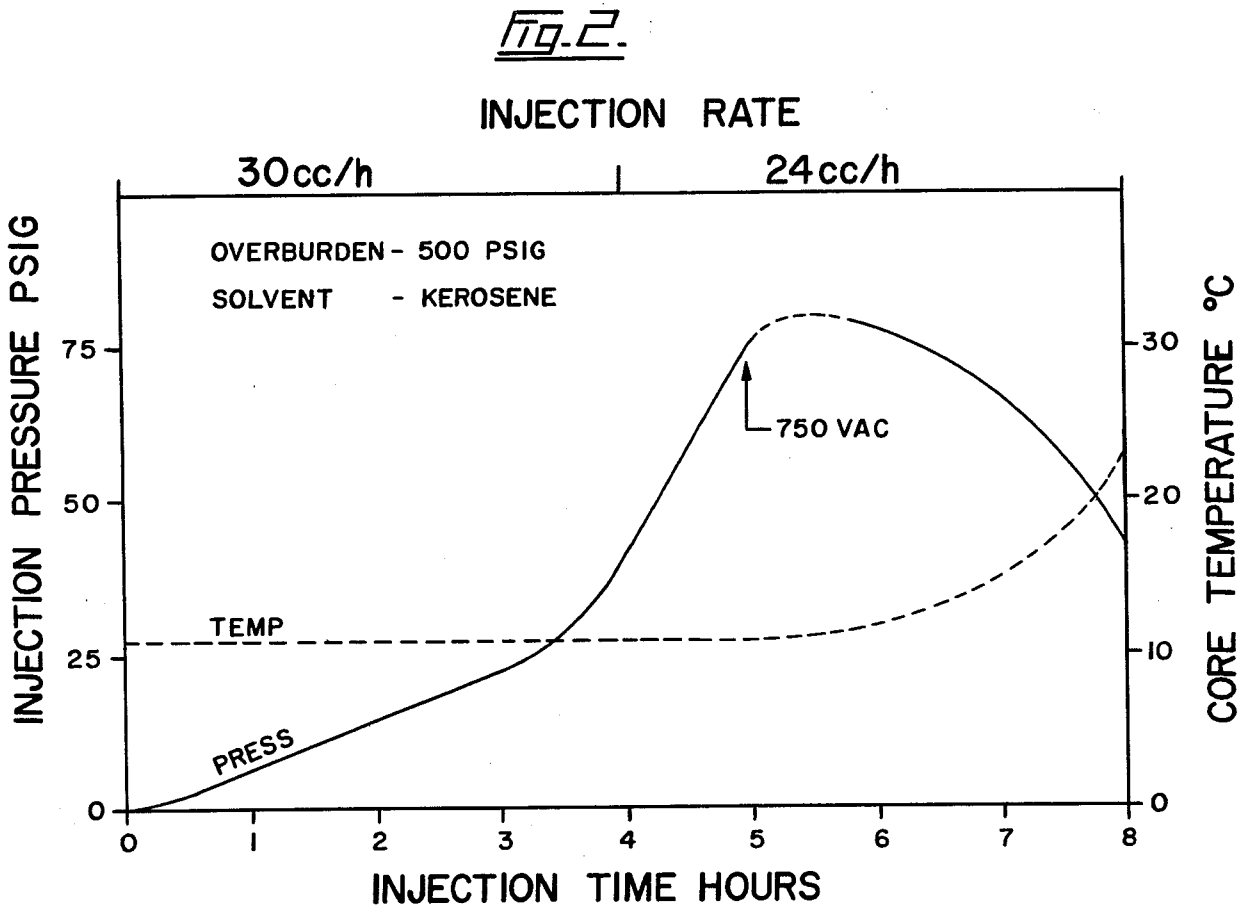
FIG. 2 is a plot showing the variation in injection pressure and oil sand temperature which occurs during solvent injection without and with the application of electrical potential.

Kerosene was injected into the base of the oil sand at a rate of 30 cc/hr. for 4 hours. The rate was then reduced to 24 cc/hr. and continued for a further 4 hours. As shown in FIG. 2, the injection pressure increased steadily.

A voltage of 750 A.C. was applied across the column for at least 3 hours of injection. The injection pressure decreased, as shown in FIG. 2.

The embodiments of the invention in which an exclusive property or privilege is claimed are defined as follows:

1. A method for opening a fluid communication channel between injection and production wells in a previously unheated heavy oil reservoir wherein the oil is not amenable to being produced by a drive fluid, which consists essentially of:

injecting a cold solvent for the heavy oil into the unheated reservoir; and while such solvent is moving through the unheated reservoir, simultaneously passing electric current between a positive electrode positioned in the injection well and a negative electrode positioned in the production well to reduce the injection pressure required.

* * * * *